US010627078B2

(12) United States Patent
Pyshos et al.

(10) Patent No.: US 10,627,078 B2
(45) **Date of Patent: *Apr. 21, 2020**

(54) METHOD AND SYSTEM FOR PRODUCING A BEAM OF ILLUMINATION HAVING SMOOTH EDGES

(71) Applicant: Eaton Intelligent Power Limited, Dublin (IE)

(72) Inventors: Steven Walter Pyshos, Peachtree City, GA (US); Ren Chao, Dongguan (CN); Scott Wegner, Peachtree City, GA (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/404,663

(22) Filed: May 6, 2019

(65) Prior Publication Data

US 2019/0257496 A1 Aug. 22, 2019

Related U.S. Application Data

(63) Continuation of application No. 15/299,046, filed on Oct. 20, 2016, now Pat. No. 10,281,112.

(Continued)

(51) Int. Cl.

*F21V 7/00* (2006.01)
*F21V 5/00* (2018.01)

(Continued)

(52) U.S. Cl.

CPC ..... *F21V 7/0091* (2013.01); *F21S 8/026* (2013.01); *F21V 5/004* (2013.01); *F21V 5/04* (2013.01);

(Continued)

(58) Field of Classification Search

CPC ..... F21V 7/0091; F21V 5/04; F21V 29/77; F21V 5/004; F21Y 2115/10

See application file for complete search history.

(56) References Cited

U.S. PATENT DOCUMENTS 8,696,154 B2 ‡ 4/2014 Hutchens ..... F21V 7/0016 362/217.05
10,281,112 B1 * 5/2019 Pyshos ..... F21V 5/045

(Continued)

OTHER PUBLICATIONS

Auer Lighting, LED Reflector Lens "Jupiter 70-Medium" Apr. 5, 2016, Product Specification.‡

(Continued)

*Primary Examiner* — Kevin Quarterman
(74) *Attorney, Agent, or Firm* — King & Spalding LLP

(57) ABSTRACT

A lighting system can comprise a light emitting diode that emits light, an optic mounted to process the emitted light, and an aperture disposed on the light-emitting side of the optic. The optic can comprise a cavity that receives the light. A portion of the received light can pass through a sidewall of the cavity, while another portion passes through a bottom of the cavity and out a front of the optic. The optic can comprise curved sides that receive the light passing through the cavity sidewall and reflect that light through the front of the optic. This reflection can condense the light to form a light beam having a beam waist. The beam waist can provide an annular separation or a radial gap between the beam of light and the aperture, with the separation providing clearance to avoid interference with the light beam.

20 Claims, 16 Drawing Sheets

Related U.S. Application Data

(60) Provisional application No. 62/244,050, filed on Oct. 20, 2015.

(51) Int. Cl.

| | |
|---|---|
| ***F21V 29/77*** | (2015.01) |
| ***F21V 5/04*** | (2006.01) |
| ***F21S 8/02*** | (2006.01) |
| *F21Y 115/10* | (2016.01) |

(52) U.S. Cl.
CPC ..... *F21V 5/045* (2013.01); *F21V 29/77* (2015.01); *F21V 29/773* (2015.01); *F21Y 2115/10* (2016.08)

(56) References Cited

U.S. PATENT DOCUMENTS

| | | | | |
|---|---|---|---|---|
| 2011/0075418 | A1‡ | 3/2011 | Mallory | F21S 8/088 362/235 |
| 2011/0261568 | A1‡ | 10/2011 | Dalsgaard | F21V 21/30 362/249.03 |
| 2014/0063810 | A1‡ | 3/2014 | Randolph | F21K 9/00 362/294 |
| 2016/0138777 | A1‡ | 5/2016 | Shen | F21K 9/233 362/308 |

OTHER PUBLICATIONS

Ledil new Olivia; Mar. 2015; Product Specification Sheet.‡
Optical Systems for XICATO XSM COB LED 80 Module LEDs; Oct. 4, 2012; Product Specification Sheet.‡

* cited by examiner
‡ imported from a related application

FIG. 1A
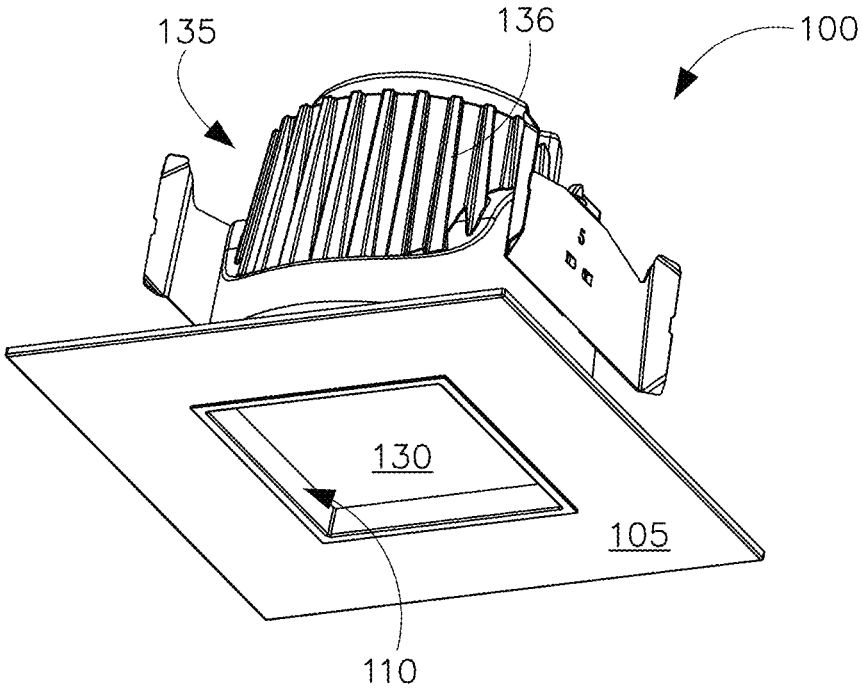
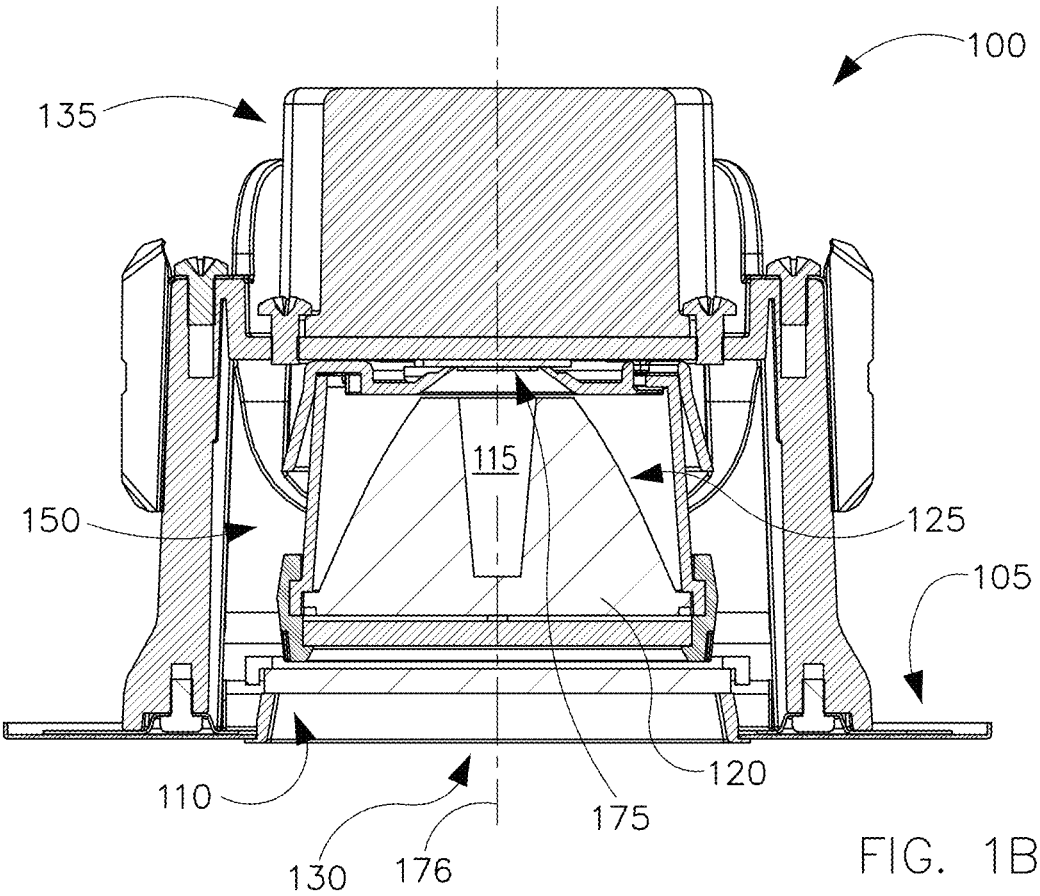
FIG. 1B

FIG. 3C
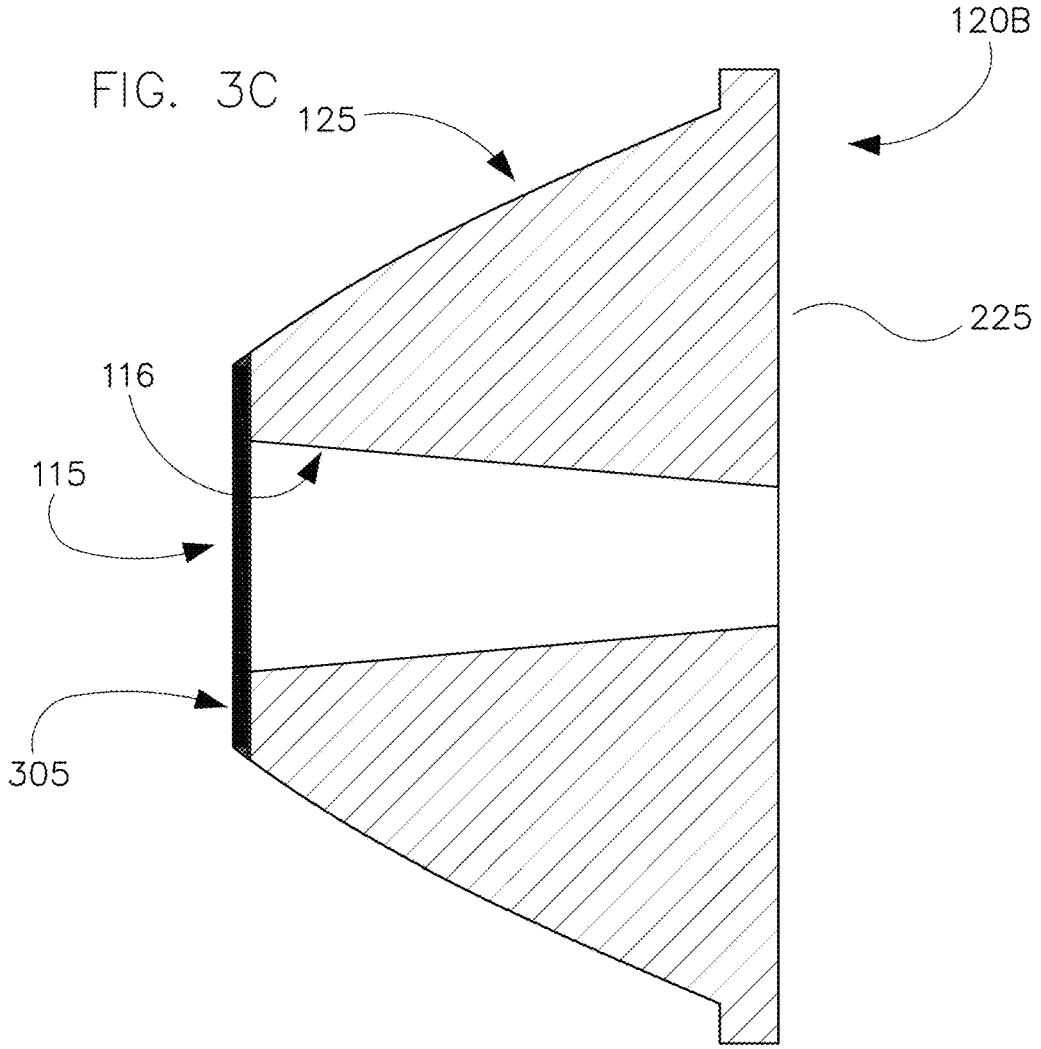
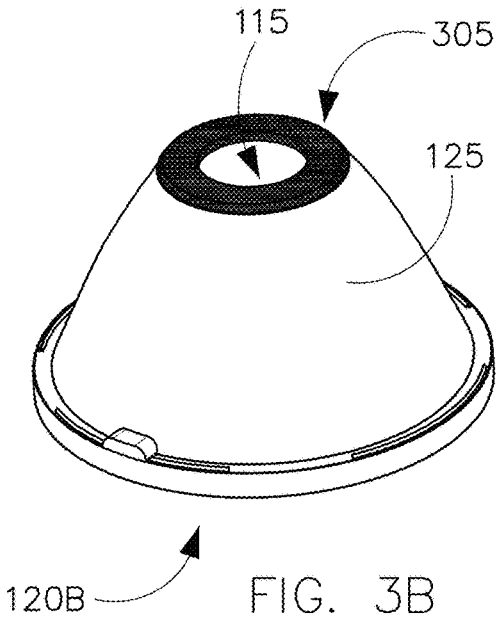
FIG. 3B
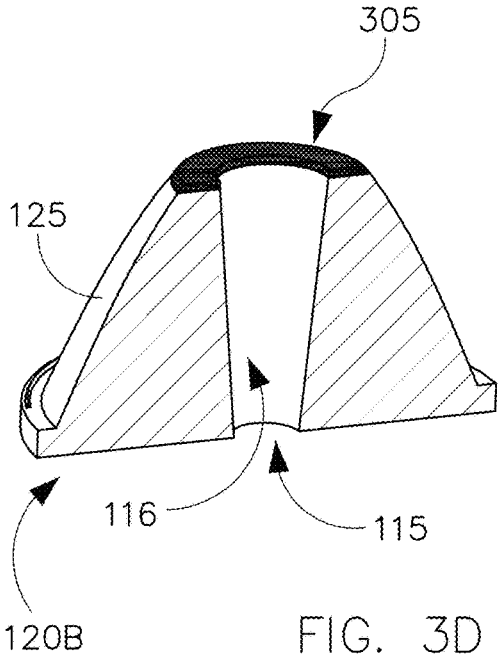
FIG. 3D

FIG. 4D
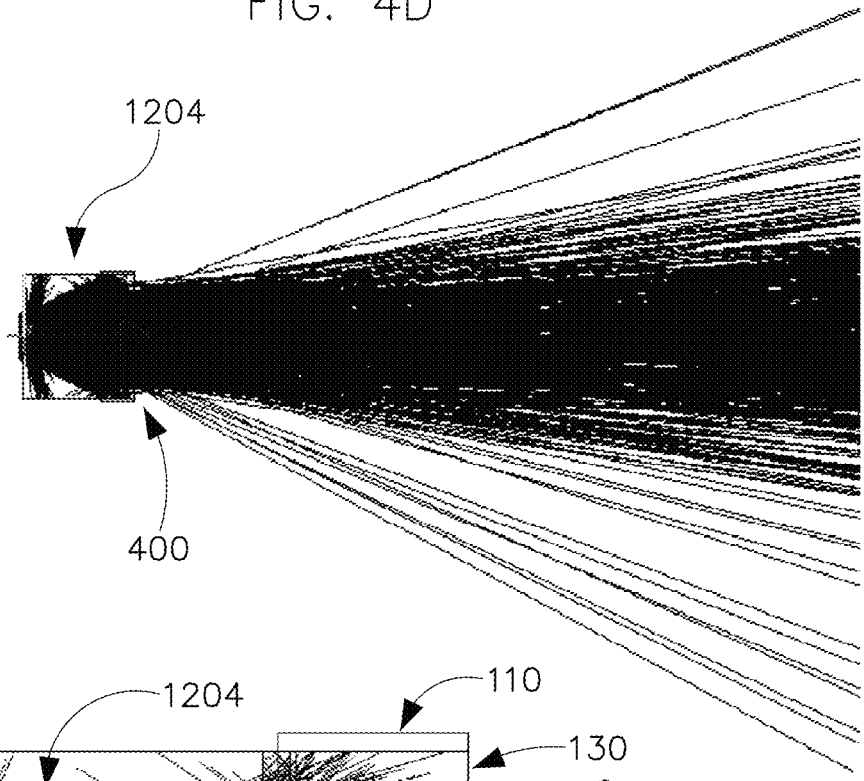
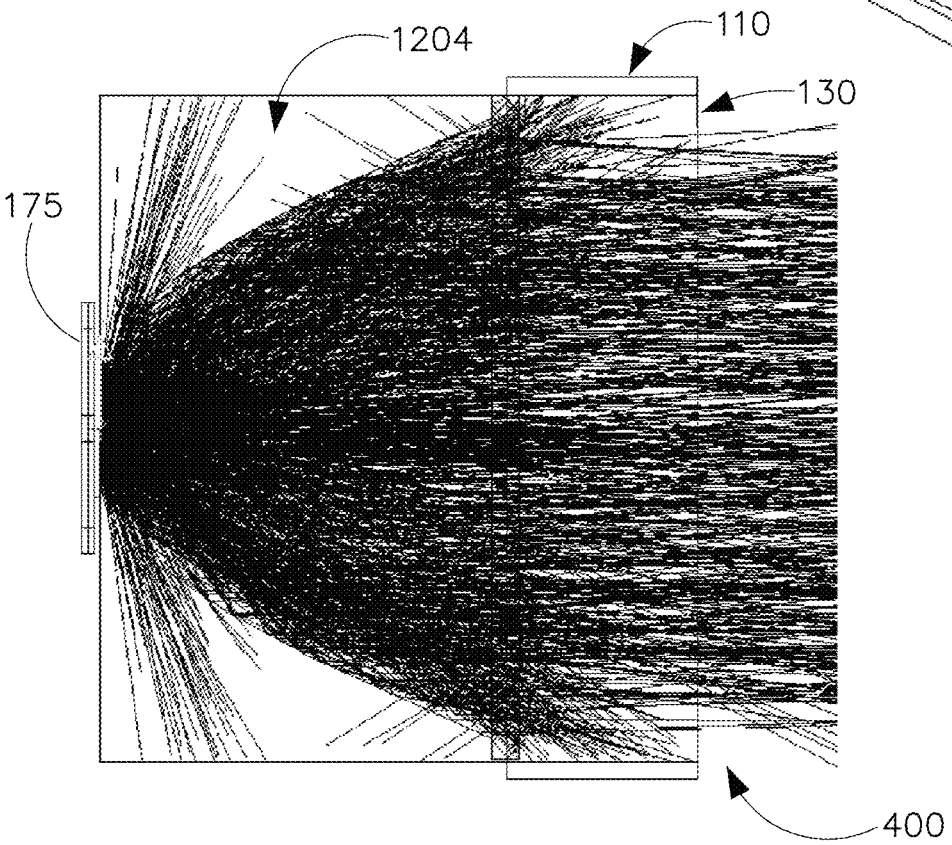
FIG. 4E

FIG. 5D
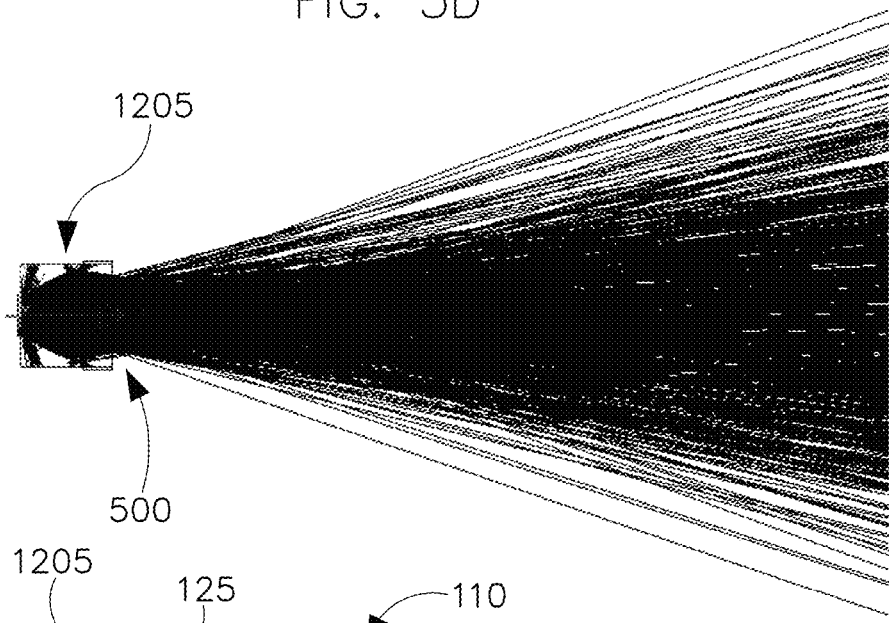
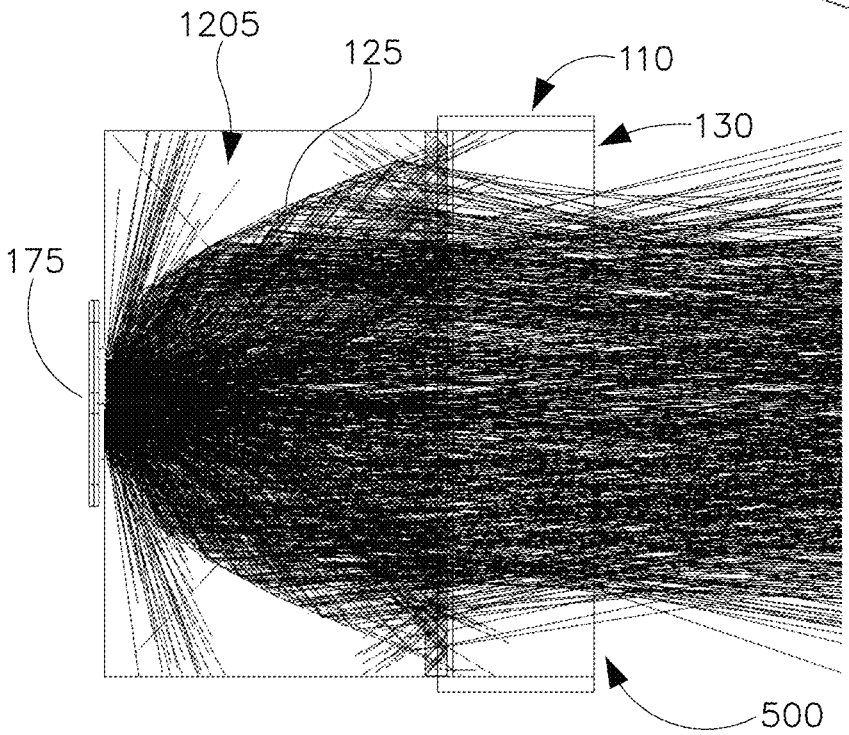
FIG. 5E

FIG. 6D
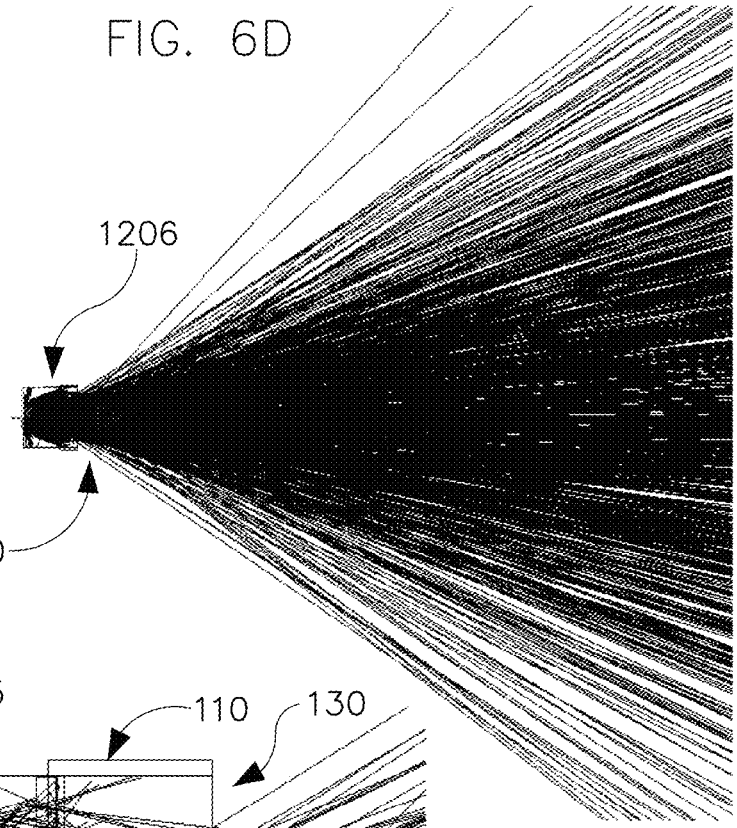
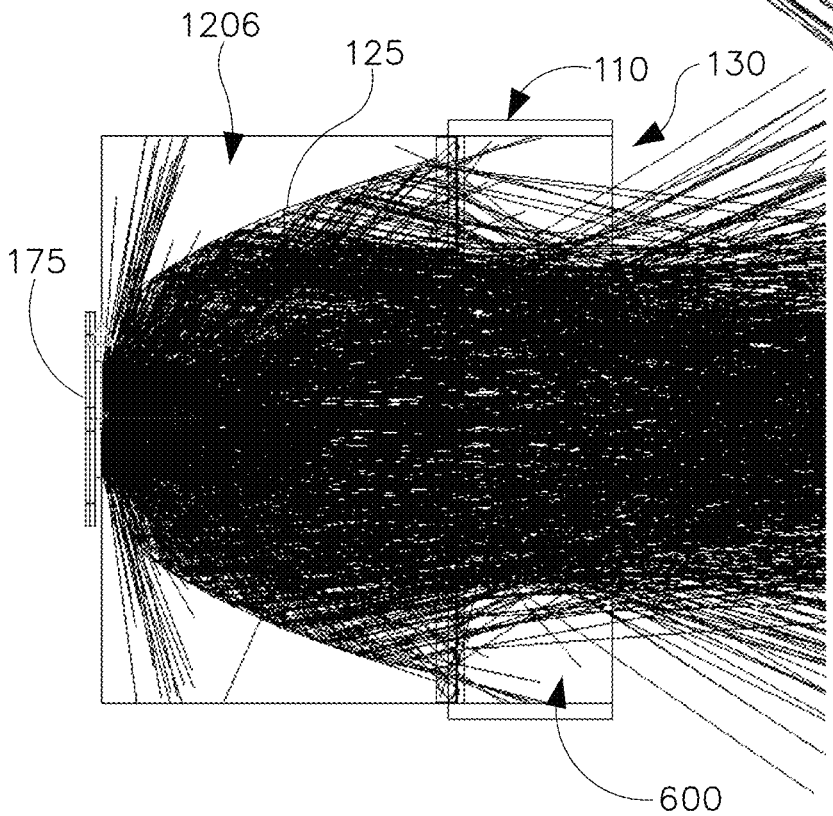
FIG. 6E

FIG. 7D
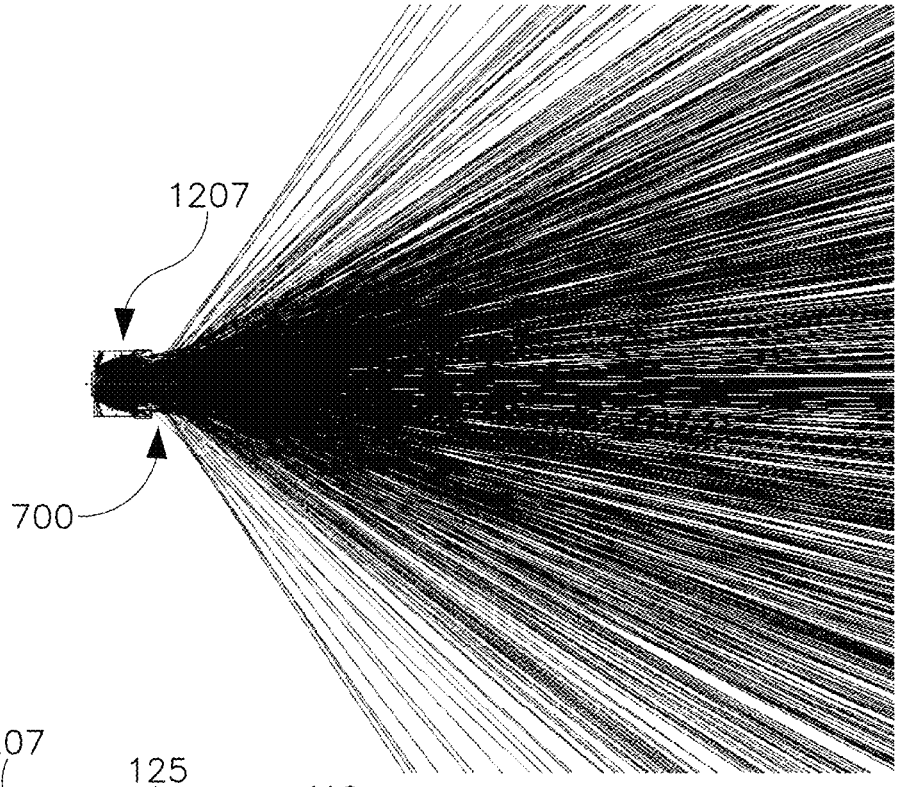
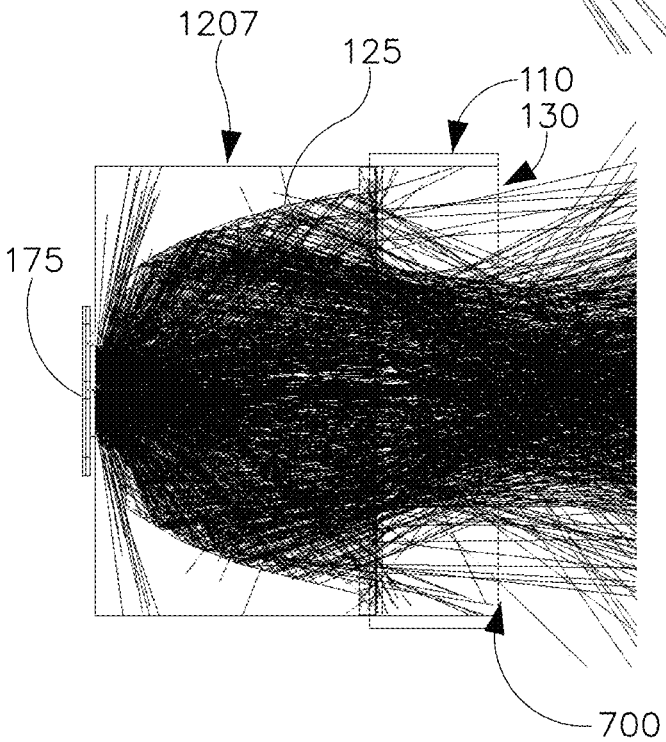
FIG. 7E

FIG. 9
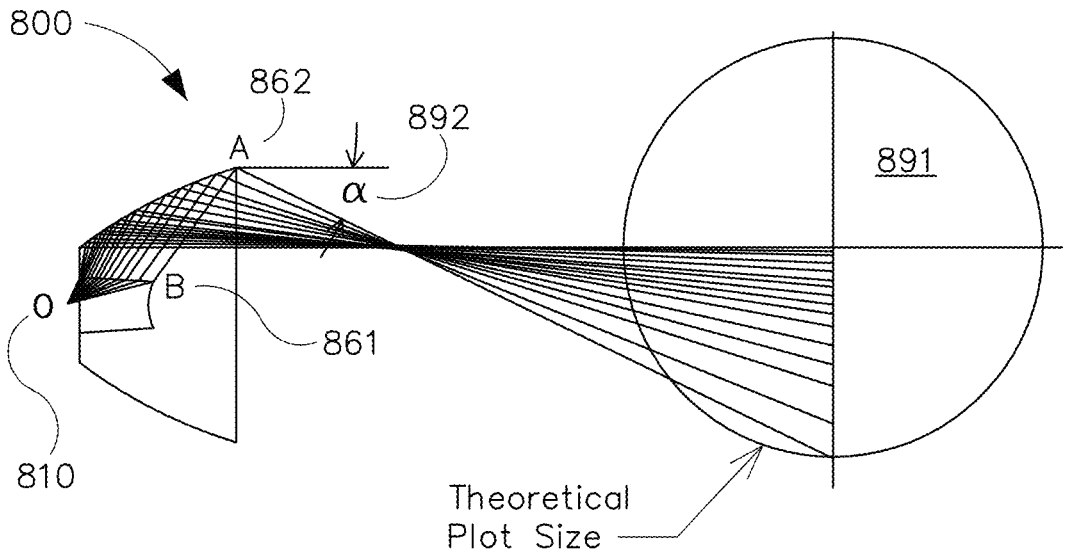
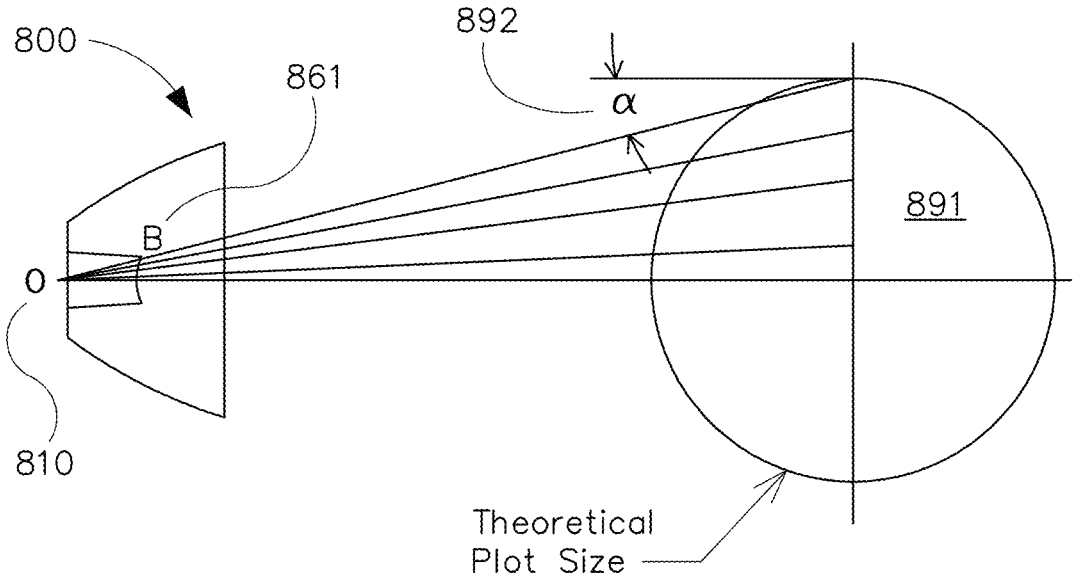
FIG. 10

METHOD AND SYSTEM FOR PRODUCING A BEAM OF ILLUMINATION HAVING SMOOTH EDGES

CROSS REFERENCE TO RELATED APPLICATIONS

This application is a continuation application of and claims priority to U.S. Non-Provisional patent application Ser. No. 15/299,046 filed Oct. 20, 2016 and titled "Method and System For Producing A Beam Of Illumination Having Smooth Edges," which application claims priority to U.S. Provisional Patent Application No. 62/244,050 filed Oct. 20, 2015 and titled "Method and System for Producing a Beam of Illumination Having Smooth Edges". The entire contents of the foregoing applications are hereby incorporated herein by reference.

TECHNICAL FIELD

Embodiments of the technology relate generally to lighting systems and more specifically to a luminaire in which a beam of illumination can converge to pass through an aperture with radial clearance or have a Gaussian distribution.

BACKGROUND

One shortcoming of many conventional light management approaches relates to control of an illumination pattern. For example, when a light emitting diode (LED) light source is recessed in a cavity of a luminaire or behind an aperture, the periphery of the cavity or aperture can interfere with passage and output of the illumination pattern. As an example, near field characteristics of LED optics when used in square-aperture recessed luminaires can create distributions on vertical and horizontal surfaces that are visually distracting or inefficient, especially when aimed off-angle from nadir. As another example, a large light emitting surface (LES) of an LED array combined with a compact reflector may not adequately manage direct flux, resulting in excessive field lumens, or stray light, diverging rays, or unsightly beam edges that maybe not be smooth. Poor efficiency and trapezoidal beam/image clipping can result when such diverging rays occur in luminaires that incorporate small, square, or pinhole apertures.

Accordingly, need for improved management of illumination is apparent. A technology addressing such a need, or some related deficiency in the art, would benefit general illumination as well as recessed lighting applications.

SUMMARY

In one aspect of the disclosure, a luminaire can comprise a light emitting diode and an optic. The optic can receive light from the light emitting diode and form a beam of illumination. The optic can condense the received light, so that the illumination beam has a beam waist. The illumination beam can have smooth edges and may approximate a Gaussian distribution in some disclosed examples. The beam waist can provide an annular separation or a radial gap between the beam of illumination and an aperture. The separation can provide clearance, to avoid the walls of the aperture interfering with the light beam.

The foregoing discussion of luminaires is for illustrative purposes only. Various aspects of the present technology may be more clearly understood and appreciated from a review of the following text and by reference to the associated drawings and the claims that follow. Other aspects, systems, methods, features, advantages, and objects of the present technology will become apparent to one with skill in the art upon examination of the following drawings and text. It is intended that all such aspects, systems, methods, features, advantages, and objects are to be included within this description and covered by this application and by the appended claims of the application.

BRIEF DESCRIPTION OF THE FIGURES

Reference will be made below to the accompanying drawings, which are not necessarily drawn to scale, and wherein:

FIGS. 1A and 1B (collectively FIG. 1) illustrate a recessed luminaire in accordance with some example embodiments.

FIGS. 3A, 3B, 3C, and 3D (collectively FIG. 3) illustrate representative optics that may be incorporated in the optical assembly of FIG. 2, with FIG. 3A further illustrating representative associated elements, in accordance with some example embodiments of the disclosure.

FIGS. 4A, 4B, 4C, 4D, and 4E (collectively FIG. 4) illustrate an optic that produces a pattern or beam of illumination having a far-field divergence of approximately 15 degrees and that may be incorporated in the optical assembly of FIG. 2 (and in the luminaire of FIG. 1) in accordance with some example embodiments of the disclosure.

FIGS. 5A, 5B, 5C, 5D, and 5E (collectively FIG. 5) illustrate an optic that produces a pattern or beam of illumination having a far-field divergence of approximately 25 degrees and that may be incorporated in the optical assembly of FIG. 2 (and in the luminaire of FIG. 1) in accordance with some example embodiments of the disclosure.

FIGS. 6A, 6B, 6C, 6D, and 6E (collectively FIG. 6) illustrate an optic that produces a pattern or beam of illumination having a far-field divergence of approximately 40 degrees and that may be incorporated in the optical assembly of FIG. 2 (and in the luminaire of FIG. 1) in accordance with some example embodiments of the disclosure.

FIGS. 7A, 7B, 7C, 7D, and 7E (collectively FIG. 7) illustrate an optic that produces a pattern or beam of illumination having a far-field divergence of approximately 55 degrees and that may be incorporated in the optical assembly of FIG. 2 (and in the luminaire of FIG. 1) in accordance with some example embodiments of the disclosure.

FIG. 9 illustrates another line diagram that may be useful for designing an optic for incorporation in the optical assembly of FIG. 2 (and in the luminaire of FIG. 1) in accordance with some example embodiments. FIG. 10 illustrates another line diagram that may be useful for designing an optic for incorporation in the optical assembly of FIG. 2 (and in the luminaire of FIG. 1) in accordance with some example embodiments.

Figure 2:
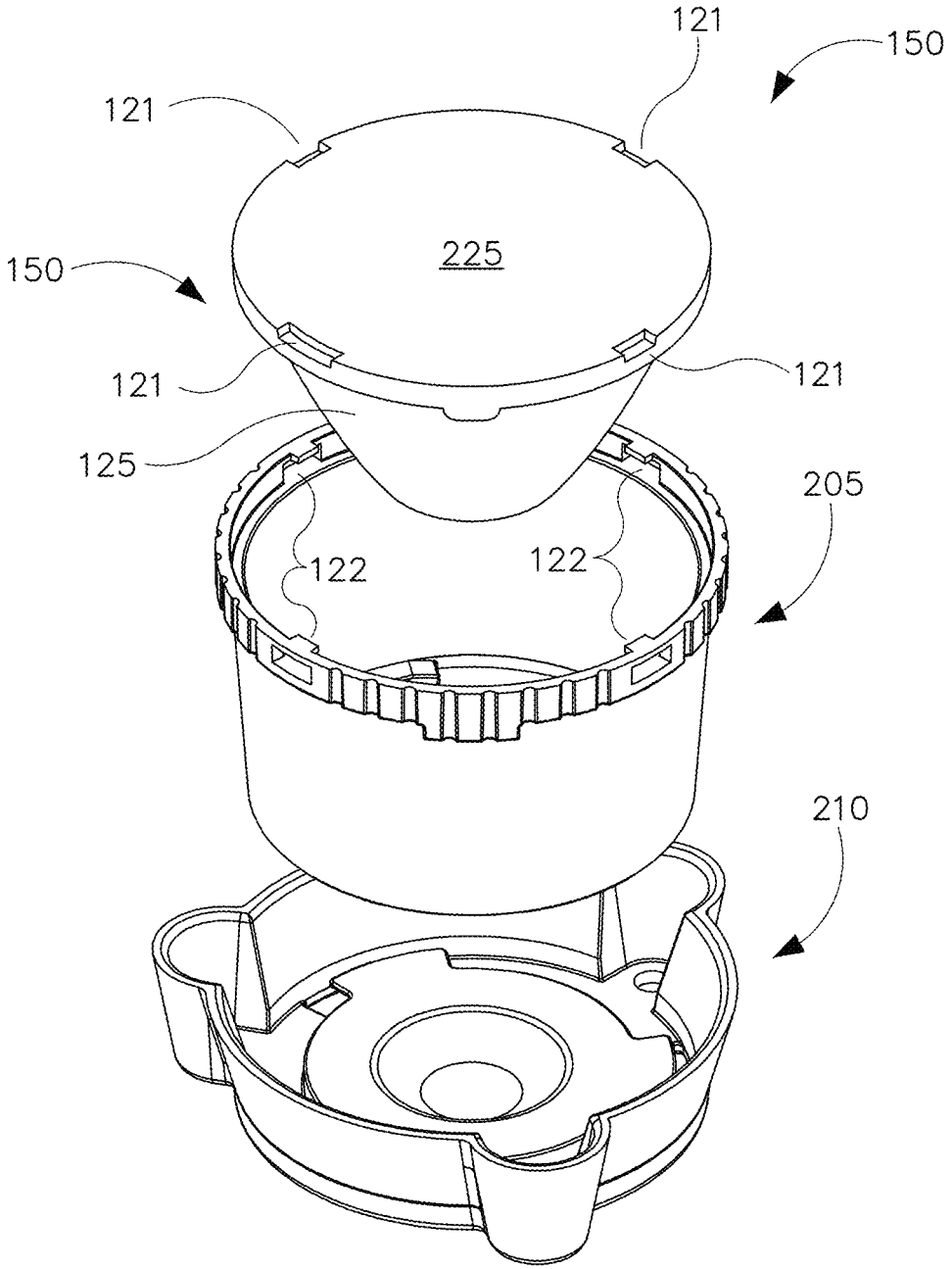
FIG. 2 illustrates an exploded perspective view of an optical assembly that may be incorporated in the recessed luminaire of FIG. 1 in accordance with some example embodiments.

The drawings illustrate only example embodiments and are therefore not to be considered limiting of the embodiments described, as other equally effective embodiments are within the scope and spirit of this disclosure. The elements and features shown in the drawings are not necessarily drawn to scale, emphasis instead being placed upon clearly illustrating the principles of the embodiments. Additionally, certain dimensions or positionings may be exaggerated to help visually convey certain principles. In the drawings, similar reference numerals among different figures designate like or corresponding, but not necessarily identical, elements.

DESCRIPTION OF EXAMPLE EMBODIMENTS

As will be discussed in further detail below, a luminaire can comprise an aperture positioned in front of a light source, so that light exits the luminaire through the aperture. The aperture can be defined by walls of a tube, for example a short section of metal formed into a square or other polygon form. An optic positioned between the aperture and the light source can produce a beam of light that has a beam waist located at the aperture. Thus, the beam can pass through the tube and the aperture without interference or clipping, with an annular separation or a radial gap between the beam waist and the walls of the aperture.

In accordance with some embodiments of the disclosure, interchangeable total internal reflectance (TIR) type lenses may be installed with or without tools to create different light distributions conforming to industry conventions for spot, narrow flood, flood, and wide flood beams (full width at half maximum, 'FWHM'). To manage stray lumens in the field, an ideal or Gaussian candela over angle boundary condition can be applied or achieved for multiple beam angles. Additionally, an illumination output can be configured or organized so that rays converge in front of an optic or near an exit plane of a pinhole aperture. In a luminaire having a square aperture, eliminating or reducing stray lumens in the field and/or providing a beam of converging rays can suppress tangential clipping, resulting in a visually pleasing distribution that can be efficient and effective in delivering illumination.

Some representative embodiments will be further described hereinafter with example reference to the accompanying drawings that describe representative embodiments of the present technology. The technology may, however, be embodied in many different forms and should not be construed as limited to the embodiments set forth herein; rather, these embodiments are provided so that this disclosure will be thorough and complete, and will fully convey the scope of the technology to those appropriately skilled in the art.

FIG. 1 illustrates a representative luminaire, while FIG. 2 illustrates a representative optical assembly for the luminaire. FIGS. 3-12 describe representative optics for the optical assembly.

Turning now to FIGS. 1A and 1B, a recessed luminaire 100 is illustrated in accordance with some example embodiments. FIG. 1A illustrates a perspective view, while FIG. 1B illustrates a cross sectional view. The luminaire 100 emits light from an aperture 110 that is illustrated as square but that may be another polygon, circular, oval, or some other appropriate geometric form in other example embodiments. A lip 105 facilitates mounting at a flat surface, for example forming a flange to facilitate recessed installation in a ceiling or other appropriate structure.

The lip 105 and associated aperture 110 form a short tube that provides a frame cavity 130 through which light passes as the light exits the luminaire 100. The frame cavity 130 leads from the aperture 110 to an optic 120 that manages light produced by a light emitting diode 175. In some example embodiments, the optic 120 is formed from a unitary piece of optical material, for example a body of clear plastic material. As illustrated, the optic 120 comprises an optic cavity 115 that receives light emitted by the light emitting diode 175. The optic 120 further comprises an internally reflective surface 125 that, in the illustrated example, reflects light via total internal reflection and is tapered and concave relative to incident light. In the illustrated embodiment, the optic cavity 115 and the internally reflective surface 125 can be viewed as rotationally symmetric about an optical axis 176 of the light emitting diode 175. The optic cavity 115 and the internally reflective surface 125 can further be viewed, in some representative embodiments, as disposed in a coaxial arrangement.

As will be further discussed below, the optic 120 is a component of an optical assembly 150. A housing 135, in the illustrated example embodiment, is disposed largely behind the light emitting diode 175. The housing 135 encloses an electrical supply and provides thermal management for operating the light emitting diode 175 and dissipation of heat via heat sink fins 136.

FIG. 2 illustrates an exploded perspective view of the optical assembly 150 in accordance with some example embodiments. In addition to the optic 120, the illustrated optical assembly 150 comprises an optic-mounting cup 205 and an associated bracket 210. The bracket facilitates mounting the optical assembly 150 in the luminaire 100. The optic 120 comprises peripherally disposed indentations 121 that receive tabs 122 projecting from the optic-mounting cup 205 for retention of the optic 120 in the cup 205. FIG. 2 further illustrates the front surface 225 of the optic 120, which emits managed light as will be further discussed below.

Figure 3A:
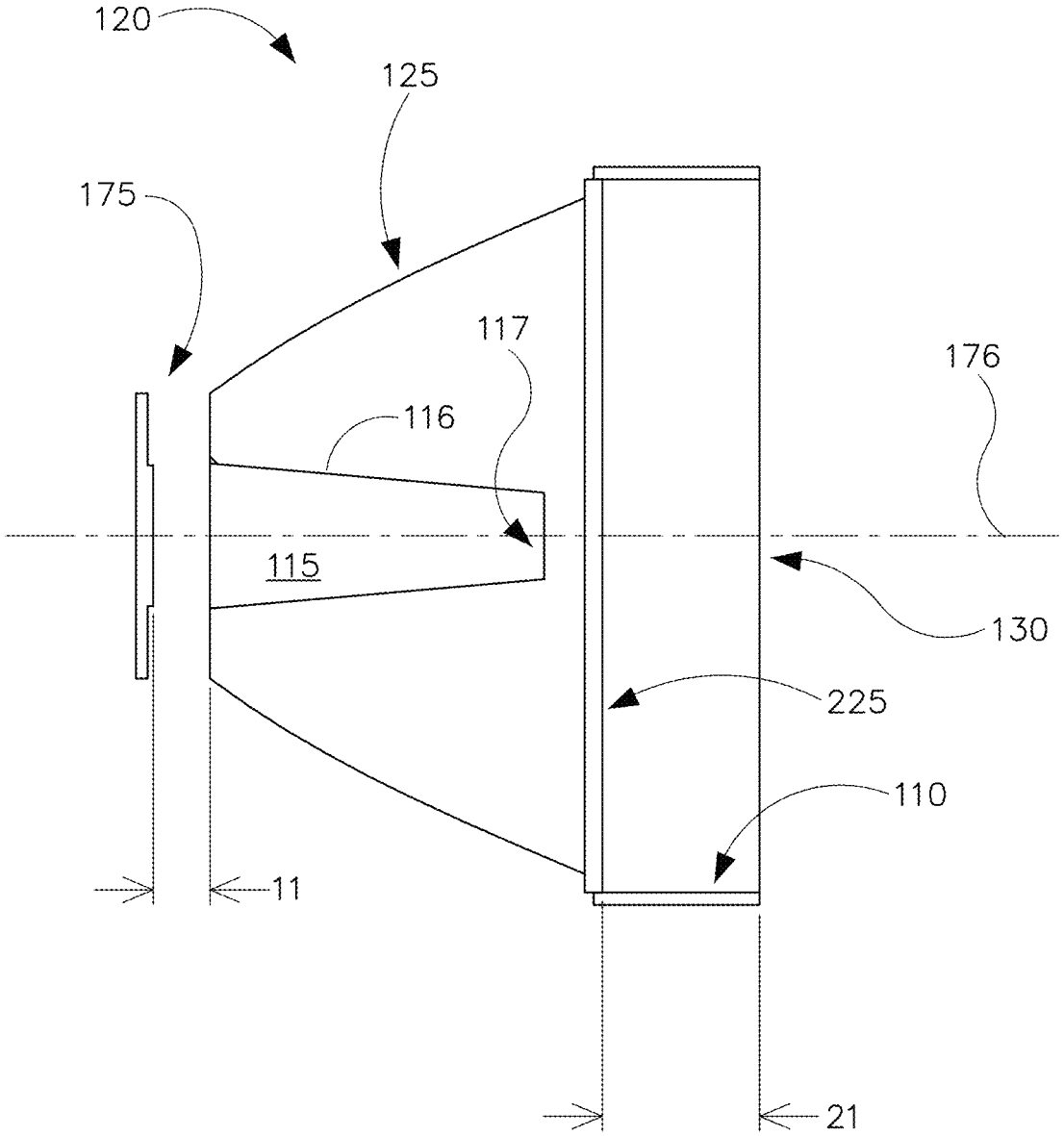

Turning to FIG. 3, some example embodiments of the optic 120 will be discussed in further detail. Referring now to FIG. 3A, this figure illustrates a cross sectional schematic view of the optic 120, the light emitting diode 175, and the frame cavity 130 in accordance with some example embodiments of the disclosure. As discussed above, the frame cavity 130 and aperture 110 comprise a short tube through which light exits the luminaire 100. The aperture 110 is defined by the walls of the short tube.

In operation, the light emitting diode 175 emits light into the optic cavity 115 of the optic 120. The light propagates from the optic cavity 115 into the body of the optic 120. A portion of the emitted light passes through the sidewall 116 of the optic cavity 115, while another part passes through the bottom 117 of the optic cavity 115. The light that passes through the bottom 117 of the optic cavity 115 exits the optic through the front surface 225. The light that passes through the sidewall 116 encounters the internally reflective surface 125, which condenses, focuses, and projects the light forward through the front surface 225 of the optic 120. As will be further discussed below, the optic 120 produces a condensing beam that has a beam waist at the aperture 110. The beam waist creates clearance so that that there is a gap between the beam and the aperture 110 and associated tube. The optic 120 manages the emitted light to facilitate interference-free passage through the frame cavity 130. Thus, light can exit the square tube unencumbered.

In some example embodiments, the distance 11 from the light emitting diode 175 to the rear of the optic 120 may be approximately 3.5 millimeters. In such an embodiment, the length 21 of the frame cavity 130 can be approximately 13.5 millimeters, and the width or diameter of the aperture 110 can be approximately 50 millimeters. Such dimensions are representative examples provided without limitation. Various embodiments may have other dimensions that may be substantially larger or substantially smaller in accordance with the applications served, for example.

Referring now to FIGS. 3B, 3C, and 3D, an example optic 120B is illustrated that is suited for incorporation in the optical assembly 150 illustrated in FIG. 2 and the luminaire 100 illustrated in FIG. 1. FIG. 3B illustrates a perspective view of the optic 120B. FIG. 3C illustrates a cross sectional view of the optic 120B. FIG. 3D illustrates a cutaway perspective view of the optic 120B.

In operation with the light emitting diode 175, the illustrated optic 120B produces a beam of light that has a far-field divergence of approximately 15 degrees, consistent with the optic embodiment illustrated in FIG. 4 and discussed below. In the illustrated example, the optic 120B can produce a beam of illumination having a beam waist. The illustrated example optic 120B can further deliver flux within a prescribed Gaussian boundary condition; for example, the optic 120B can produce a beam of illumination that fits an ideal Gaussian curve within a range of one percent error.

The optic 120B illustrated in FIGS. 3B, 3C, and 3D comprises a mask 305 of light-blocking material disposed adjacent the exterior optical surface surrounding the entrance to the optic cavity 115. The mask 305 can block or absorb light emitted by the light emitting diode 175 at a steep angle relative to the axis 176. That is, a portion of the light emitted by the light emitting diode can be oriented off of the axis 176 at an angle for incidence on the mask 305, and the mask 305 can block continued propagation of that light.

In some example embodiments, the mask 305 can comprise a layer of black paint or ink that blocks or absorbs stray light to improve stray light performance of the optic 120B, and thus of the luminaire 100. In some other embodiments, the mask 305 can comprise a plastic component that is black or otherwise opaque to block stray light and improve optical performance. The plastic component can be bonded or glued to the optic 120B, for example.

In the illustrated embodiment of FIGS. 3B, 3C, and 3D, the optic 120B comprises an optic cavity 115 that tapers down towards the light emitting surface 225 of the optic 120B. That is, the diameter of the optic cavity 115 decreases with increasing cavity depth towards the front surface 225 of the optic 120B.

As discussed above, the sidewall 116 of the optic cavity 115 transmits a portion of the light emitted from the light emitting diode 175 (not illustrated in FIGS. 3B, 3C, and 3D) for transmission through the body of the optic 120B and incidence upon and reflection by the surface 125. In the example embodiment of FIGS. 3B, 3C, and 3D, the optic cavity 115 extends completely through the optic 120B. In operation, a portion of the light emitted by the light emitting diode 175 propagates along the axis 176 and emerges from the front surface 125 of the optic 120B without incidence on the sidewall 116 of the optic cavity 120. In this embodiment, light can pass completely through the optic 120B without any refraction or losses.

Figure 4A:
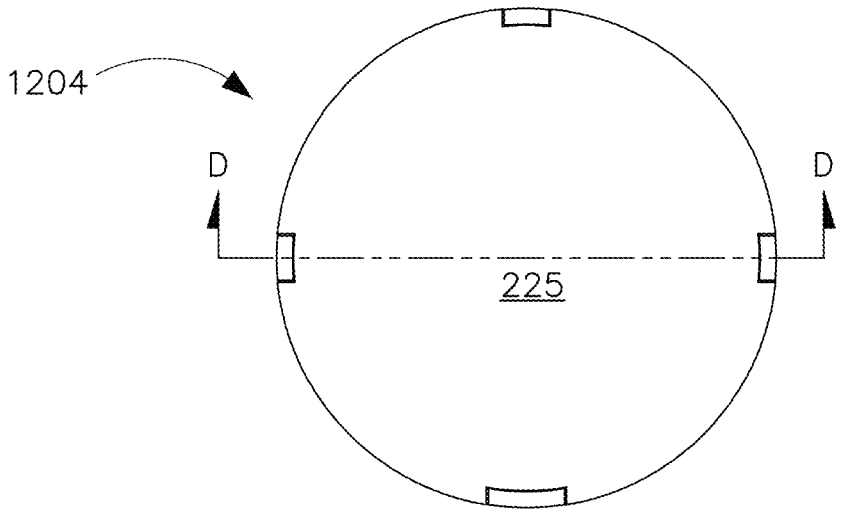
Figure 4B:
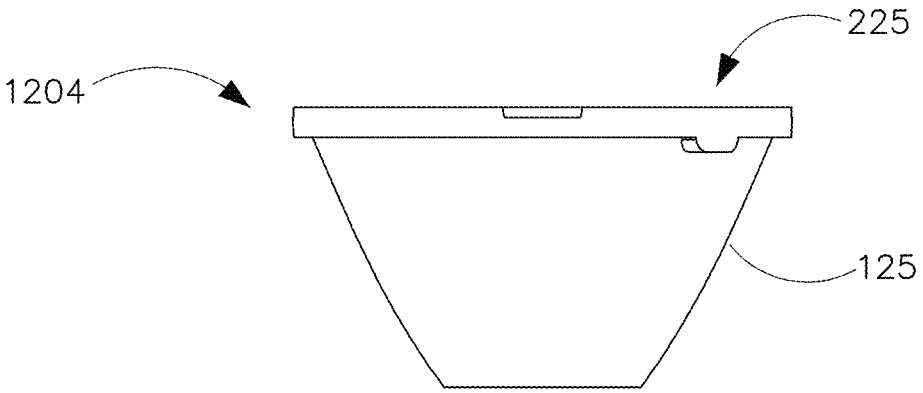
Figure 4C:
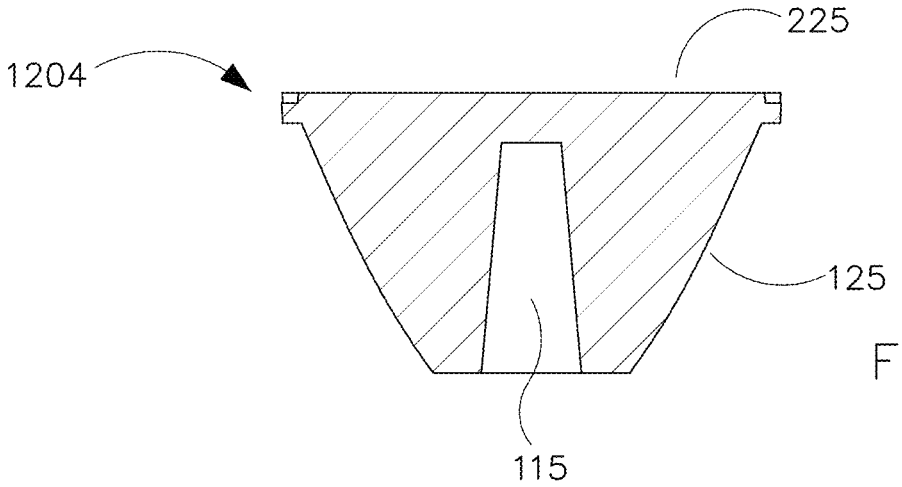

Turning now to FIGS. 4A, 4B, 4C, 4D, and 4E, an optic 1204 is illustrated that produces a pattern or beam of illumination having a far-field divergence of approximately 15 degrees in accordance with some example embodiments of the disclosure. The optic 1204 can be incorporated in the optical assembly 150 illustrated in FIG. 2 and in the luminaire 100 illustrated in FIG. 1. FIG. 4A illustrates a view looking straight at the surface 225 of the optic 1204. FIG. 4B illustrates a side view of the optic 1204. FIG. 4C illustrates a cross sectional view of the optic 1204 taken through the D-D section illustrated in FIG. 4A. As discussed below, FIGS. 4D and 4E illustrate example ray traces for the optic 1204.

FIG. 4D illustrates a representative light ray pattern for the optic 1204, showing an example beam waist 400 that provides beam clearance through the frame cavity 130 and the associated aperture 110 and tube. As discussed above, the beam waist 400 and associated clearance helps avoid clipping or otherwise interfering with the beam edges. The resulting beam profile can have smooth beam edges that provide desirable illumination. FIG. 4E illustrates a magnified view of the light rays propagating through the optic 1204 and the resulting beam waist 400. In the illustrated ray traces, which are generated via computer simulation, approximately 1,000 out of 5,000,000 rays propagate in random or unintended directions that may be characterized as stray. Accordingly, the resulting illumination has a relatively low level of stray light.

Figure 5A:
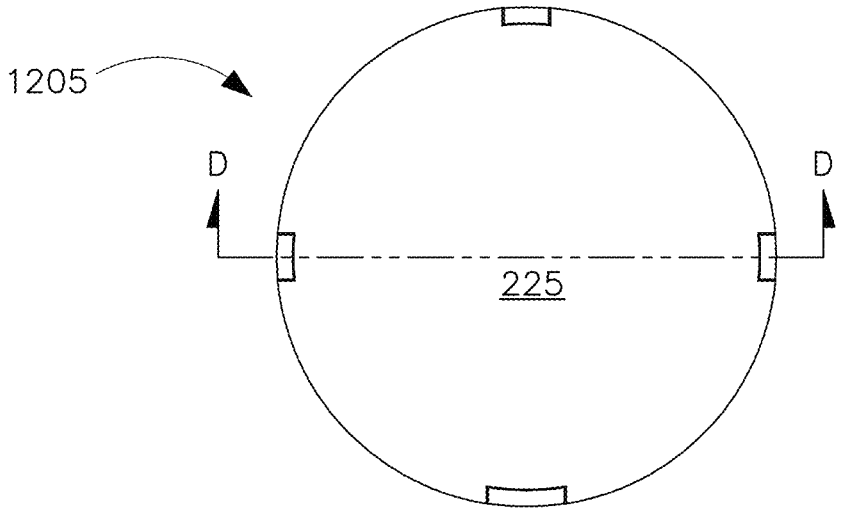
Figure 5B:
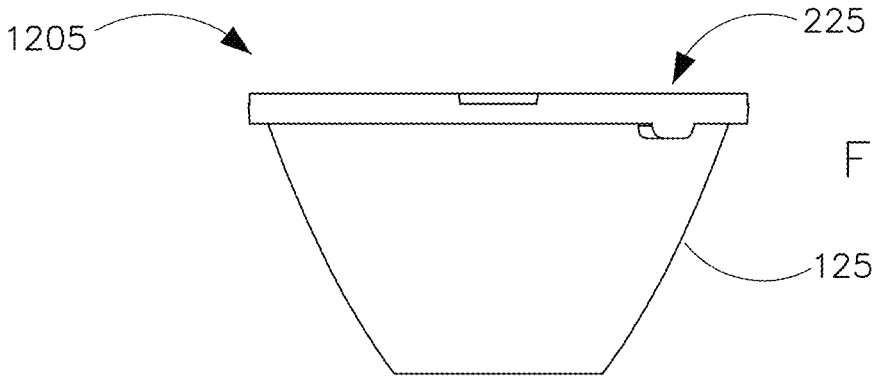
Figure 5C:
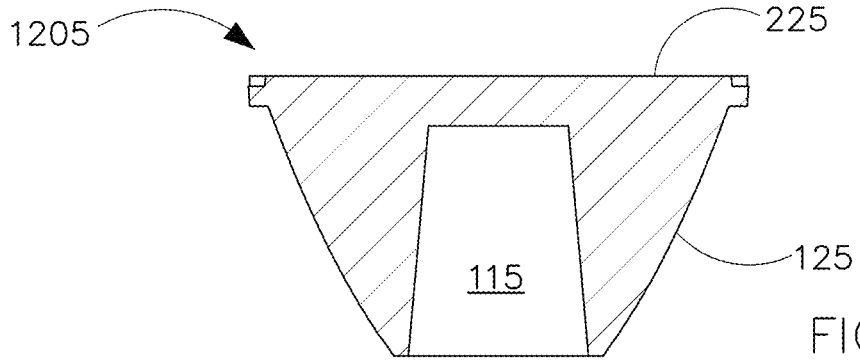

Turning now to FIGS. 5A, 5B, 5C, 5D, and 5E, an optic 1205 is illustrated that produces a pattern or beam of illumination having a far-field divergence of approximately 25 degrees in accordance with some example embodiments of the disclosure. The optic 1205 can be incorporated in the optical assembly 150 illustrated in FIG. 2 and in the luminaire 100 illustrated in FIG. 1. FIG. 5A illustrates a view looking straight at the surface 225 of the optic 1205. FIG. 5B illustrates a side view of the optic 1205. FIG. 5C illustrates a cross sectional view of the optic 1205 taken through the D-D section illustrated in FIG. 5A. As discussed below, FIGS. 5D and 5E illustrate example ray traces for the optic 1205.

FIG. 5D illustrates a representative light ray pattern for the optic 1205, showing an example beam waist 500 that provides beam clearance through the frame cavity 130 and the associated aperture 110 and tube. As discussed above, the beam waist 500 and associated clearance helps avoid clipping or otherwise interfering with the beam edges. The resulting beam profile can have smooth beam edges that provide desirable illumination. FIG. 5E illustrates a magnified view of the light rays propagating through the optic 1205 and the resulting beam waist 500. In the illustrated ray traces, which are generated via computer simulation, approximately 1,000 out of 5,000,000 rays propagate in random or unintended directions that may be characterized as stray. Accordingly, the resulting illumination has a relatively low level of stray light.

Figure 6A:
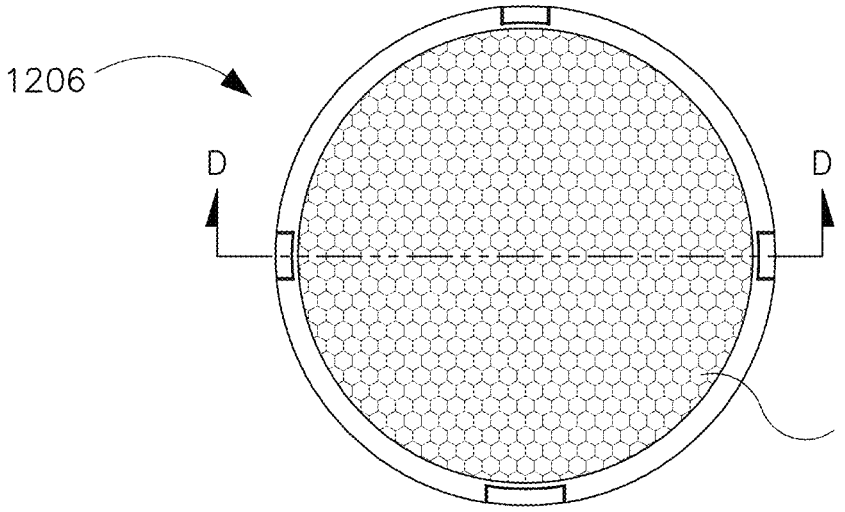
Figure 6B:
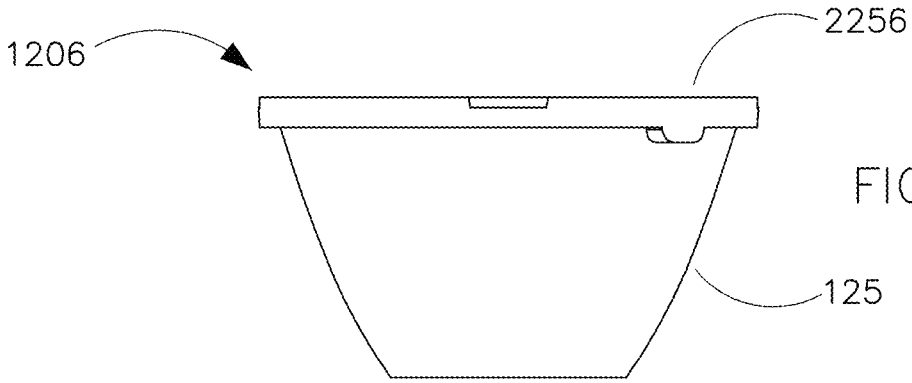
Figure 6C:
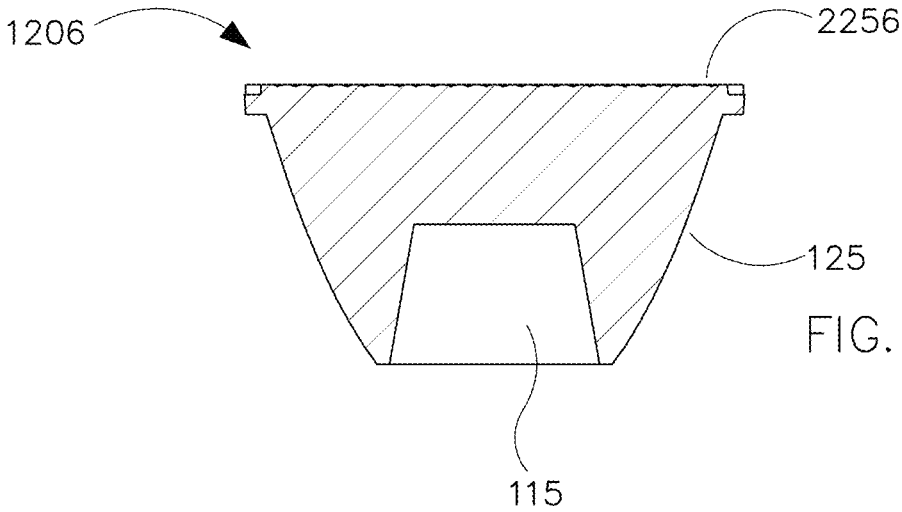

Turning now to FIGS. 6A, 6B, 6C, 4D, and 6E, an optic 1206 is illustrated that produces a pattern or beam of illumination having a far-field divergence of approximately 40 degrees in accordance with some example embodiments of the disclosure. The optic 1206 can be incorporated in the optical assembly 150 illustrated in FIG. 2 and in the luminaire 100 illustrated in FIG. 1. FIG. 6A illustrates a view looking straight at the surface 2256 of the optic 1206. In the illustrated embodiment, the surface 2256 is patterned with microlens features for enhanced light manipulation via refraction. The microlens features can refract light exiting the surface 2256, for example. FIG. 6B illustrates a side view of the optic 1206. FIG. 6C illustrates a cross sectional view of the optic 1206 taken through the D-D section illustrated in FIG. 6A. As discussed below, FIGS. 6D and 6E illustrate example ray traces for the optic 1206.

FIG. 6D illustrates a representative light ray pattern for the optic 1206, showing an example beam waist 600 that provides beam clearance through the frame cavity 130 and the associated aperture 110 and tube. As discussed above, the beam waist 600 and associated clearance helps avoid clipping or otherwise interfering with the beam edges. The resulting beam profile can have smooth beam edges that provide desirable illumination. FIG. 6E illustrates a magnified view of the light rays propagating through the optic 1206 and the resulting beam waist 600. In the illustrated ray traces, which are generated via computer simulation, approximately 1,000 out of 5,000,000 rays propagate in random or unintended directions that may be characterized as stray. Accordingly, the resulting illumination has a relatively low level of stray light.

Figure 7A:
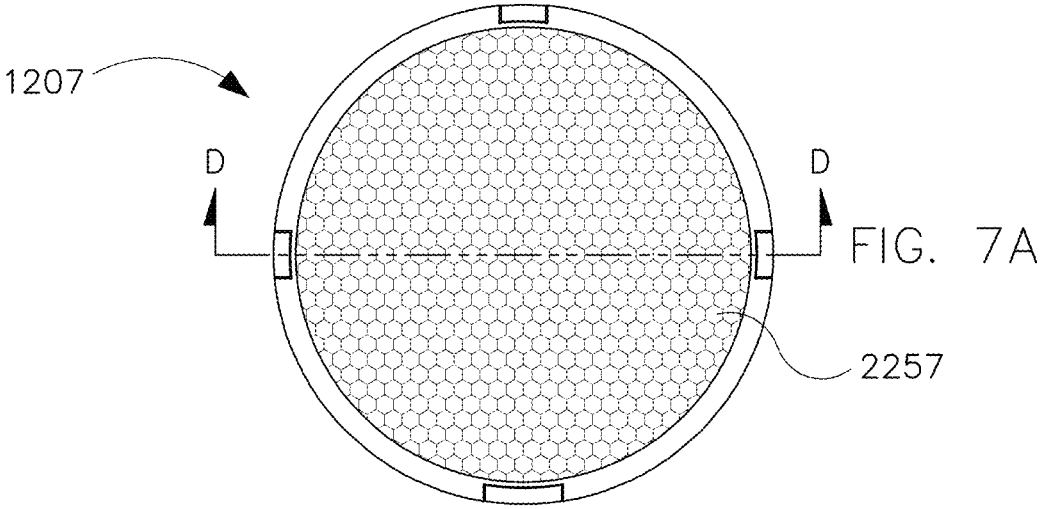
Figure 7B:
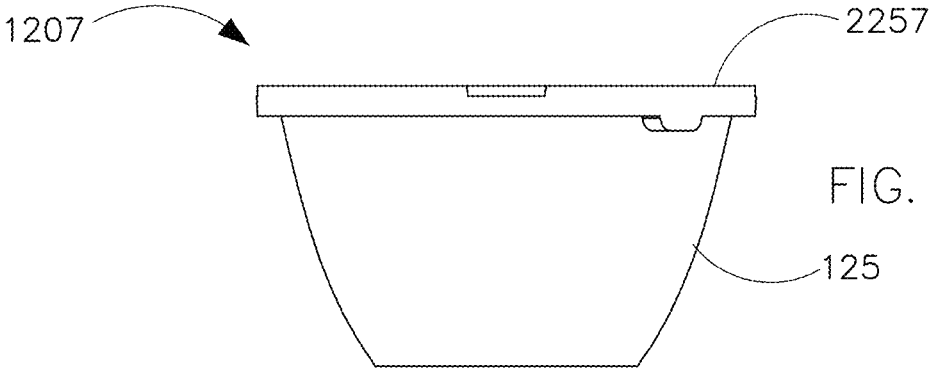
Figure 7C:
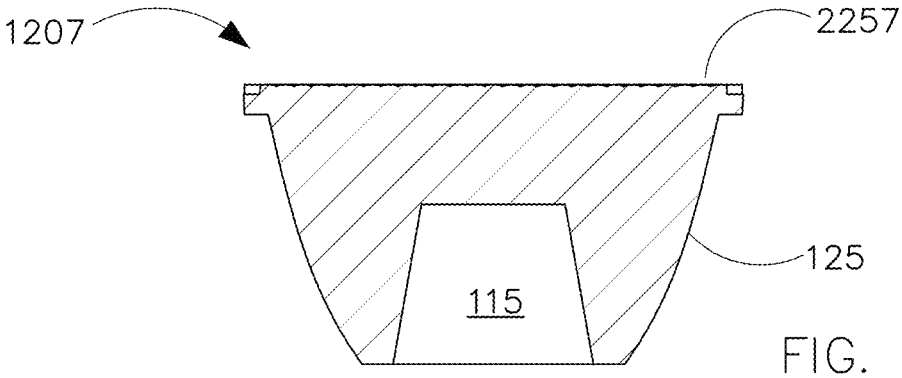

Turning now to FIGS. 7A, 7B, 7C, 7D, and 7E, an optic 1207 is illustrated that produces a pattern or beam of illumination having a far-field divergence of approximately 55 degrees in accordance with some example embodiments of the disclosure. The optic 1207 can be incorporated in the optical assembly 150 illustrated in FIG. 2 and in the luminaire 100 illustrated in FIG. 1. FIG. 7A illustrates a view looking straight at the surface 2257 of the optic 1207. In the illustrated embodiment, the surface 2257 is patterned with microlens features for enhanced light manipulation via refraction. The microlens features can refract light exiting the surface 2257, for example. FIG. 7B illustrates a side view of the optic 1207. FIG. 7C illustrates a cross sectional view of the optic 1207 taken through the D-D section illustrated in FIG. 7A. As discussed below, FIGS. 7D and 7E illustrate example ray traces for the optic 1207.

FIG. 7D illustrates a representative light ray pattern for the optic 1207, showing an example beam waist 700 that provides beam clearance through the frame cavity 130 and the associated aperture 110 and tube. As discussed above, the beam waist 700 and associated clearance helps avoid clipping or otherwise interfering with the beam edges. The resulting beam profile can have smooth beam edges that provide desirable illumination. FIG. 7E illustrates a magnified view of the light rays propagating through the optic 1207 and the resulting beam waist 700. In the illustrated ray traces, which are generated via computer simulation, approximately 1,000 out of 5,000,000 rays propagate in random or unintended directions that may be characterized as stray. Accordingly, the resulting illumination has a relatively low level of stray light.

Turning now to FIGS. 8, 9, 10, 11, and 12, further details about some example optic embodiments will be described, including a discussion of example design methodology that supports a wide range of variations, applications, and preferences.

Figure 8:
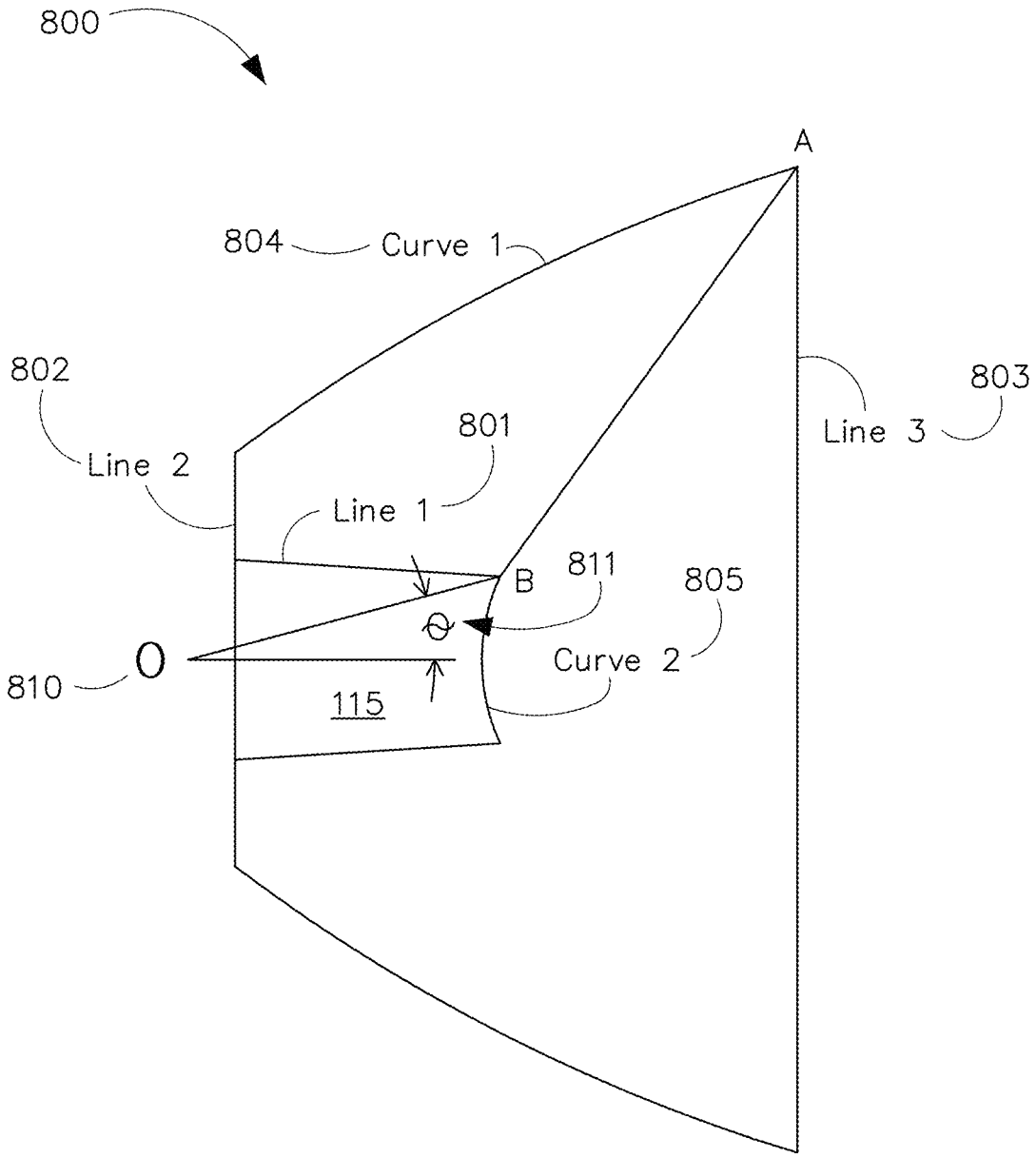
FIG. 8 illustrates a line diagram that may be useful for designing an optic for incorporation in the optical assembly of FIG. 2 (and in the luminaire of FIG. 1) in accordance with some example embodiments.

An example optical configuration, as illustrated in FIG. 8, can result from utilizing a combination of ray tracing and structural optimization. In an example embodiment, a design process can proceed by calculating a path trend of light theoretically, resulting in an initial structure of the surfaces of optic 800. Then, precisely simulating repeatedly can refine or optimize the structure and surfaces. The resulting design can yield efficiency of optical utilization and illumination under a prerequisite target angle range.

As illustrated in FIG. 8, the optic 800 can comprise a rotation of the indicated profile, which is composed of Line 1 801, Line 2 802, Line 3 803, Curve 1 804, and Curve 2 805. A theoretical point source at point O 810 can be used to model rays emitted within the angle Θ (theta) 811. To facilitate mass production, for example via molding, Line 1 801 can have a general taper. The material of the optic 800 in the illustrated design of FIG. 8 can be selected as PMMA, with a refractive index 1.4935, for example.

Turning now to FIGS. 9 and 10 with reference back to FIG. 8, Point O 810 can be considered as the location of the light source. The light emitting from Point O 810 radiates inside optic cavity 115 of the optic 800 and is divided into two parts.

The first part, illustrated in FIG. 9, is the light taking O-B (810-861) as the boundary line and deviating from the normal direction of the light source. The light crosses the surface of Line 1 801 and is reflected totally on the surface of Curve 1 804, and ultimately emits from the surface of the optic 800 at Line 3 803.

The second part of the light, illustrated in FIG. 10, emitting from Point O 810 is the light taking O-B (810-861) as the boundary line and deviating towards the normal direction of the light source. The light arrives at the surface of Curve 2 805, and emits from the surface of Line 3 803 after refraction on the surface of Curve 2 805. Especially if the direction of light is alongside O-B (810-861), the refracted light will coincide with B-A (861-862) and arrive at the trailing edge of Curve 1 804, which made the first part of light in full use of the surface of Curve 1 804 to reflect totally and accomplish desirable efficiency of optical utilization.

Assuming that the light emits in the direction of O-B (810-861) with the emitting angle θ 811, after crossing Line 1 801 and Curve 1 804, the light source angle θ 811 can be kept between θ and 90°. After refracted by the optical surface of Line 1 801, the light with emitting angle close to 90° will emit into the beginning point of Curve 1 804, and emit into the target plane 891 with angle 0° after being totally reflected by the Curve 1 804. However, after being refracted by the optical surface of Line 1 801, the light with emitting angle close to θ will emit into the end point of Curve 1 804, and emit into the target plane 891 with angle α 892 after totally reflected by the Curve 1 804. The angle α can be calculated by the angle of designed target half-light-intensity. The emitting light angle between θ and 90° may be totally reflected from the beginning and end of Line 1 801, the emitting angle of which could keep the nature of obliquing to α gradually. Accordingly various example outlines of Curve 1 804 can be readily generated using the foregoing design methodology.

As illustrated in FIG. 9, the emitting angle of the second part of the light is between 0° and θ. After the light near 0° is refracted by Curve 2 805, it emits into the target plane 891 with 0°. Similarly, the angle α 892 can be calculated by the angle of designed target half-light-intensity. The emitting light angle is between 0° and θ, and the target plane 891 can be designed according to the light with angle between 0° to α refracted by Curve 2 805, in which the emitting light can keep maintain uniformity with gradient increase. The outline of Curve 2 805 can thus be generated using the foregoing design methodology.

As illustrated in FIG. 10, after obtaining an optical profile, commercial ray tracing computer software can be utilized to simulate and to validate whether the initial model can achieve the desired design effect and target angle. Additionally, the initial structure can be optimized slightly and validated repeatedly.

In order to make the light from the surface of Line 3 803 to the destination surface uniform in optical effect, surface microstructures can be utilized to achieve the effect. One suitable microstructure is non-spherical eye lens array (40° and 55°). A second suitable microstructure is Gaussian micro-structure scattering surface (5° and 25°). These example structures can produce light uniform in optical effect, without loss of optical performance, and with reduced glare. The resulting illumination can be visually comfortable, for example with a diffuse or smooth quality.

Figure 11:
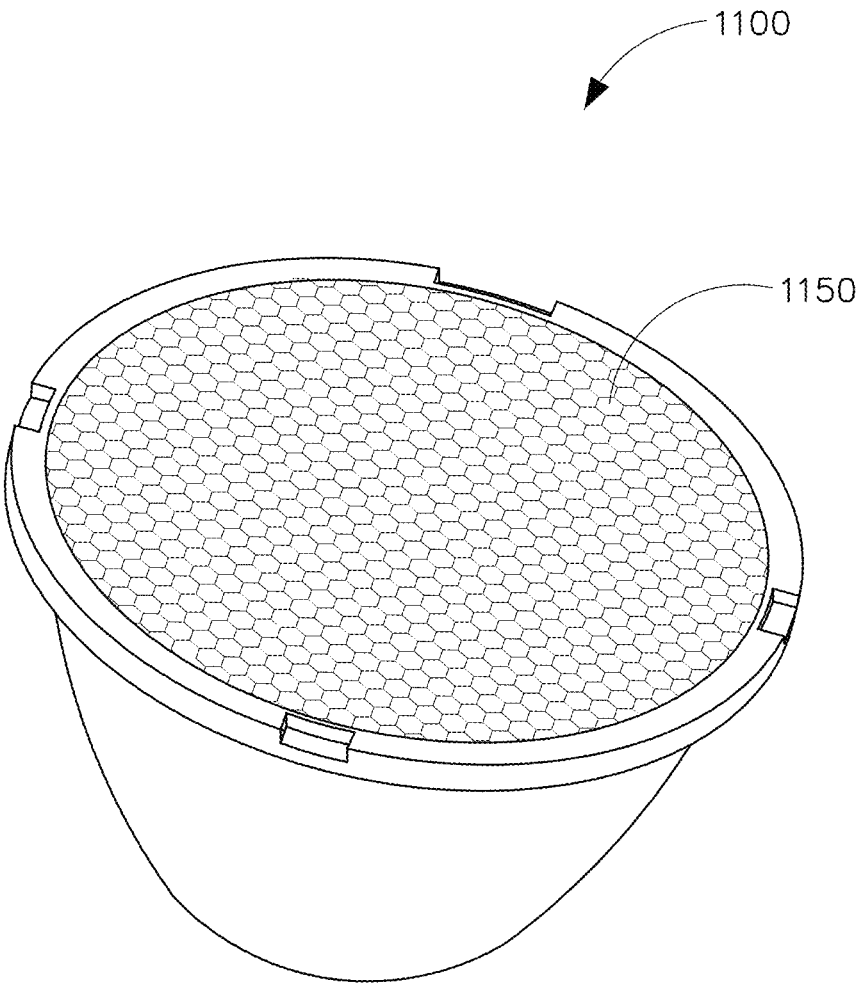
FIG. 11 illustrates a non-spherical fly-eye lens formed of a single spherical convex lens array as may be incorporated in the optical assembly of FIG. 2 (and in the luminaire of FIG. 1) in accordance with some example embodiments.

FIG. 11 illustrates an optic 110, comprising a non-spherical fly-eye lens formed of a single spherical convex lens array 1150, that can be incorporated in the optical assembly 150 illustrated in FIG. 2 and in the luminaire 100 illustrated in FIG. 1. The single spherical convex lens array 1150 can be incorporated into the optic 1206 or the optic 1207 respectively illustrated in FIGS. 6 and 7, for example.

In operating principle, the light with a single direction crosses the fly-eye lens array 1150 and is refracted by each single aspheric convex lens in the array 1150. The light refracted by each non-spherical convex lens is overlaid and added with each other. The resulting light can provide well-distributed illumination.

Figure 12:
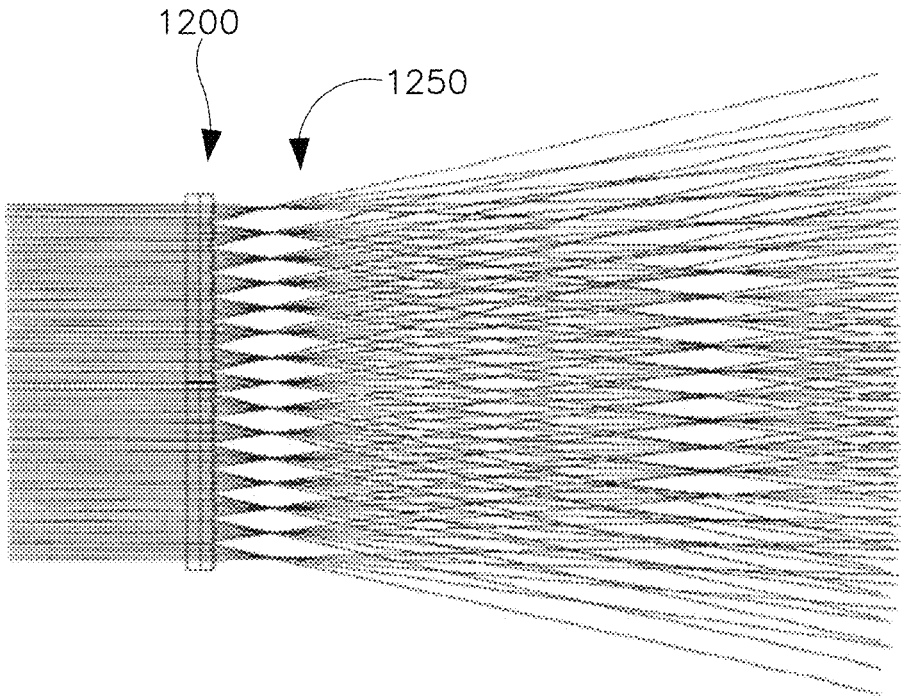
FIG. 12 illustrates a Gauss microstructure surface and accompanying ray traces for an optic as may be incorporated in the optical assembly of FIG. 2 (and in the luminaire of FIG. 1) in accordance with some example embodiments.

FIG. 12 illustrates a Gauss microstructure surface 1200, and accompanying ray traces 1250, that can be formed on a light-emitting surface of an optic as may be incorporated in the optical assembly of FIG. 2 (and in the luminaire of FIG. 1) in accordance with some example embodiments. The Gauss microstructure surface 1200 can be incorporated into the optic 1206 or the optic 1207 respectively illustrated in FIGS. 6 and 7, for example.

Fine etching on a fabrication mold can be utilized to obtain irregular micro convex structures on optical lens surface. In order to achieve the difference of uniform light and changes of angle, the diameter of the convex microstructures 1200 can be between 0.05 mm and 0.2 mm in some embodiments. When collimated light is incident on the Gaussian optical microstructures 1200, the emitted rays can be presented as Gaussian distribution at a certain angle, resulting in uniform performance.

Many modifications and other embodiments of the disclosures set forth herein will come to mind to one skilled in the art to which these disclosures pertain having the benefit of the teachings presented in the foregoing descriptions and the associated drawings. Therefore, it is to be understood that the disclosures are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A luminaire comprising:

a light emitting diode (LED) light source that is operable to transmit an emitted light along an axis;

an optic that is disposed adjacent the LED light source and oriented to manage the emitted light, the optic comprising:

a front surface;

a rear surface extending between an outer edge and an inner edge, the inner edge of the rear surface defining an aperture that faces and is adjacent to the LED light source;

an outer sidewall extending from a perimeter of the front surface to the outer edge of the rear surface, an inner surface of the outer sidewall being totally internally reflective; and an inner sidewall that defines a cavity that is formed in the optic, the cavity oriented to receive the emitted light, the inner side wall extending from the inner edge of the rear surface towards the front surface, wherein the inner sidewall is configured to pass a portion of the emitted light therethrough towards the inner surface of the outer sidewall; and a mask attached to the rear surface and configured to block a portion of the emitted light from the LED light source.

2. The luminaire of claim 1, wherein the front surface of the optic is a patterned surface through which the axis passes.

3. The luminaire of claim 1, further comprising a frame, the frame comprising a frame cavity, the frame cavity comprising a front and a rear.

4. The luminaire of claim 1, wherein the inner surface of the outer sidewall is concave and is smooth.

5. The luminaire of claim 1, wherein the cavity tapers inward with increasing distance from the light source.

6. The luminaire of claim 1, wherein the inner surface of the outer sidewall has an increasing diameter with increasing distance from the LED light source.

7. The luminaire of claim 1, wherein the inner surface of the outer sidewall and the inner sidewall are tapered in opposite directions.

8. The luminaire of claim 1, wherein a front portion of the second cavity is substantially flat.

9. The luminaire of claim 3, wherein the frame comprises a recessed lighting trim.

10. The luminaire of claim 1, wherein the cavity extends completely through the optic.

11. The luminaire of claim 1, wherein the optic is configured to manage stray light in the field.

12. The luminaire of claim 1, wherein the optic is configured to produce convergence of the emitted light.

13. The luminaire of claim 3, wherein the optic is configured to convert the emitted light into a beam that has a beam waist at the front of the frame cavity.

14. The luminaire of claim 13, wherein the frame cavity comprises a square aperture disposed at the front of the frame cavity, and wherein a radial gap separates the beam waist from the square aperture.

15. A luminaire comprising:

a light emitting diode that comprises an optical axis;

an optic that is disposed adjacent the light emitting diode and that comprises:

a rear surface oriented towards the light emitting diode and a front surface oriented away from the light emitting diode;

an inner sidewall that extends from an inner edge of the rear surface to an inner edge of the front surface, the inner sidewall defining a cavity that extends completely through the optic, along the optical axis; and an outer sidewall extending from a perimeter of the front surface to an outer edge of the rear surface, the outer sidewall comprising a totally internally reflective concave inner surface, wherein the outer sidewall is coaxially disposed relative to the cavity, wherein the totally internally reflective concave inner surface defined by the outer sidewall increases in diameter with increasing distance from the light emitting diode; and a frame that supports the optic and comprises an aperture through which light exits the luminaire, wherein the inner sidewall and the outer sidewall of the optic are configured to convert light emitted by the light emitting diode into a beam that converges at a distance from the front surface to provide a beam waist that is adjacent the aperture of the frame.

16. The luminaire of claim 15, wherein a gap radially separates the beam waist from the aperture of the frame.

17. The luminaire of claim 15, wherein a mask of material is disposed on the rear surface of the optic adjacent the cavity for blocking a portion of light that emits from the light emitting diode.

18. The luminaire of claim 15, wherein the beam has a distribution that is within one percent of an ideal Gaussian distribution.

19. The luminaire of claim 15, wherein the inner sidewall that defines the cavity tapers inward with increasing distance from the light emitting diode.

20. The luminaire of claim 15, wherein the frame is a recessed lighting trim.

* * * * *